US007777174B2

(12) United States Patent
Miwa

(10) Patent No.: US 7,777,174 B2
(45) Date of Patent: Aug. 17, 2010

(54) IMAGE FORMING APPARATUS INCLUDING A RECORDING MEDIUM DETECTOR WITH A LIGHT SHIELD

(75) Inventor: Atsushi Miwa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/833,497

(22) Filed: Aug. 3, 2007

(65) Prior Publication Data

US 2008/0048138 A1 Feb. 28, 2008

(30) Foreign Application Priority Data

Aug. 24, 2006 (JP) ..... 2006-227952

(51) Int. Cl.
*G06M 7/00* (2006.01)
*H01J 5/02* (2006.01)

(52) U.S. Cl. ..... 250/221; 250/239

(58) Field of Classification Search ..... 250/205, 250/214 SW, 239, 559.27, 231.13–231.18, 250/221, 214 PR, 208.1; 271/258.01, 258.03, 271/258.04, 301, 262, 265.01, 152; 101/484–486; 399/405, 107, 388, 13, 16
See application file for complete search history.

(56) References Cited

U.S. PATENT DOCUMENTS 4,298,116 A * 11/1981 Niemeyer ..... 194/203
4,548,401 A * 10/1985 Nishikawa ..... 271/265.01
5,516,220 A * 5/1996 Ishikawa et al. ..... 400/616.1
5,713,059 A * 1/1998 Ishikawa ..... 399/18
5,962,861 A * 10/1999 Fowler ..... 250/559.27
6,032,950 A * 3/2000 Ikeda ..... 271/258.01
6,408,147 B1 * 6/2002 Oshida ..... 399/82
6,805,509 B2 * 10/2004 Ahn ..... 400/709
2005/0236760 A1 * 10/2005 Kang ..... 271/152

FOREIGN PATENT DOCUMENTS

JP 5-4760 A 1/1993
JP 10-245137 A 9/1998
JP 10-307045 A 11/1998
JP 2004-131221 A 4/2004
JP 2005-162342 A 6/2005

* cited by examiner

*Primary Examiner*—Que T Le
*Assistant Examiner*—Jennifer Bennett
(74) *Attorney, Agent, or Firm*—Banner & Witcoff, Ltd.

(57) ABSTRACT

An image forming apparatus that forms an image on a recording medium includes a sensor including a light emitting element configured to emit light and a light receiving element configured to receive light emitted from the light emitting element. A sensor actuator is configured to cause a transition between a first state where the light emitted from the light emitting element is received at the light receiving element and a second state where the light emitted from the light emitting element is not received at the light receiving element in response to a recording medium being detected. A light shield is coupled to the sensor actuator and configured to cover at least a part of the sensor and to prevent light other than light emitted from the light emitting element from entering the light receiving element in the second state.

15 Claims, 19 Drawing Sheets

IMAGE FORMING APPARATUS INCLUDING A RECORDING MEDIUM DETECTOR WITH A LIGHT SHIELD

CROSS REFERENCE TO RELATED APPLICATION

This application claims priority from Japanese Patent Application No. 2006-227952, filed on Aug. 24, 2006, the entire subject matter of which is incorporated herein by reference.

FIELD

Aspects of the invention relate to image forming apparatuses such as laser printers, LED printers, inkjet printers, and copiers.

BACKGROUND

In an image forming apparatus, detection should be made as to whether a recording medium such as a sheet of paper has passed a specified position or is present on a manual feed tray.

Some image forming apparatuses include a photo sensor and a sensor actuator. The photo sensor has a light emitting element and a light receiving element, which are disposed facing each other. The sensor actuator has a light path shielding plate that moves between a position where the light path shielding plate cuts off a light path from the light emitting element to the light receiving element and a position where the light path shielding plate opens the light path. Based on an output signal from the photo sensor, the presence of a recording medium in the manual feed tray is detected.

SUMMARY

Aspects of the invention may provide an image forming apparatus configured to prevent a photo sensor from detecting falsely.

BRIEF DESCRIPTION OF THE DRAWINGS

Illustrative aspects of the invention will be described in detail with reference to the following figures in which like elements are labeled with like numbers and in which.

DETAILED DESCRIPTION

A first illustrative embodiment of the invention will be described in detail with reference to the accompanying drawings. An image forming apparatus can be applied to an electrophotographic laser printer in this illustrative embodiment.

Figure 1:
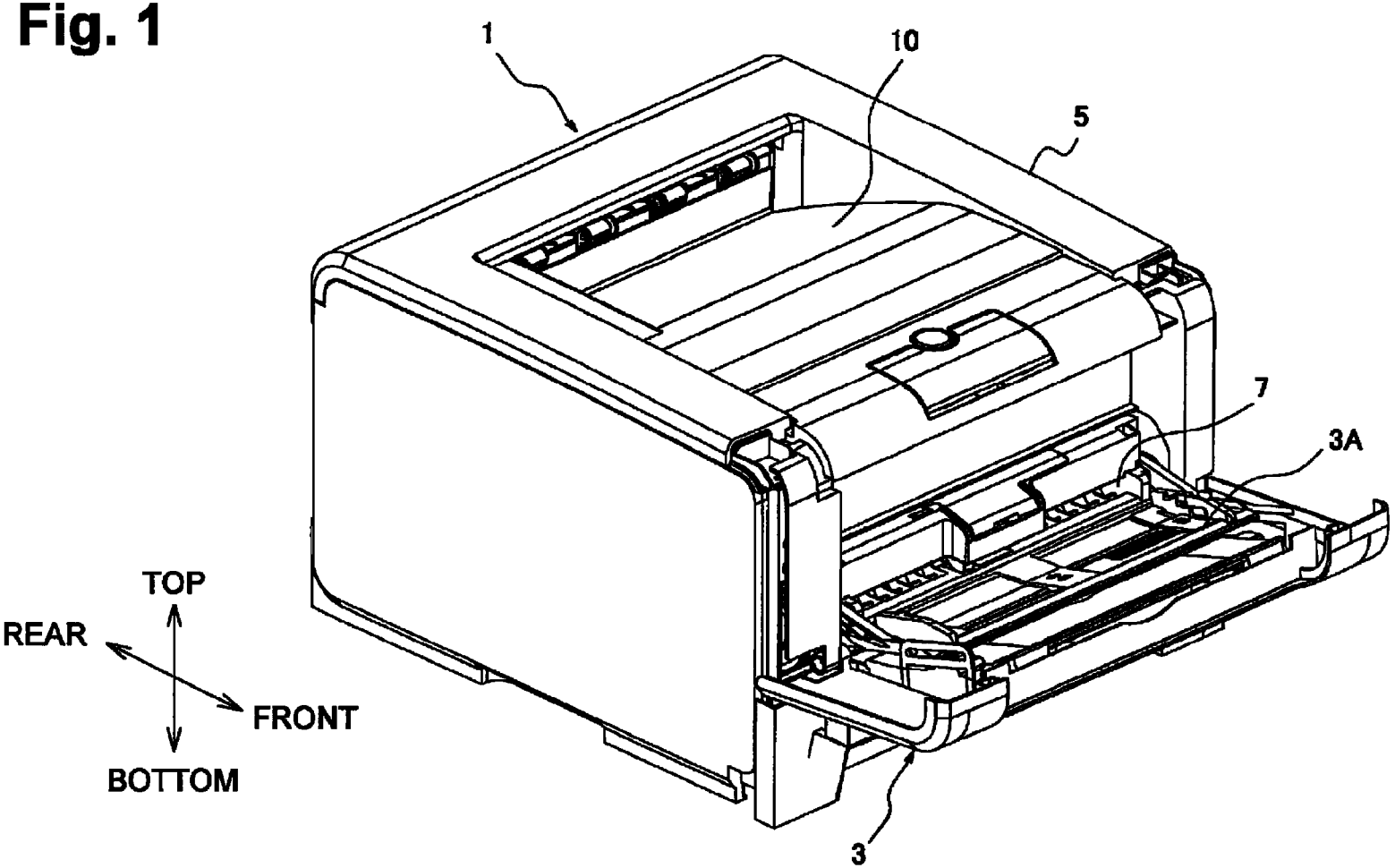
FIG. 1 is a perspective view of a laser printer according to an illustrative embodiment of the invention where a manual tray is open.

As shown in FIG. 1, a laser printer 1 is provided with a manual feed tray 3 at a front side of a housing 5. The manual feed tray 3 is configured to receive a recording medium such as plain paper and a transparency (hereinafter referred to as a recording sheet), which is supplied by a user. The manual feed tray 3 is pivotally coupled to the front side of the housing 5.

Figure 2:
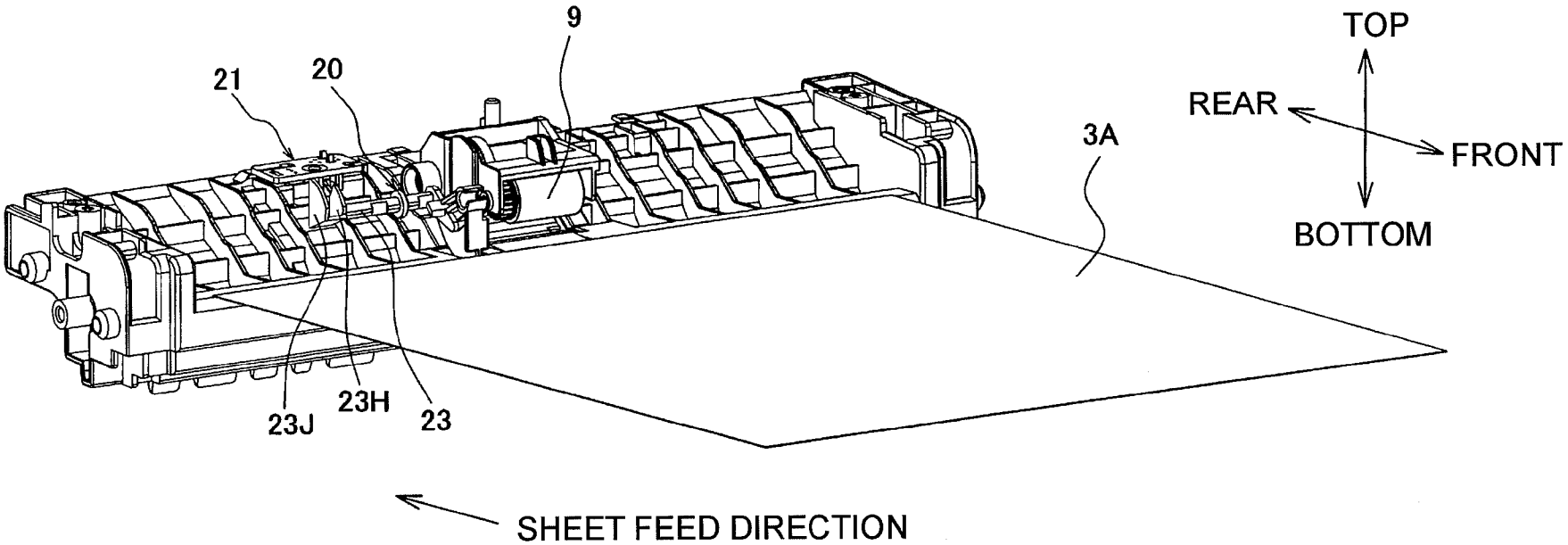
FIG. 2 is a perspective view of a sheet sensor provided in the manual tray.
Figure 3:
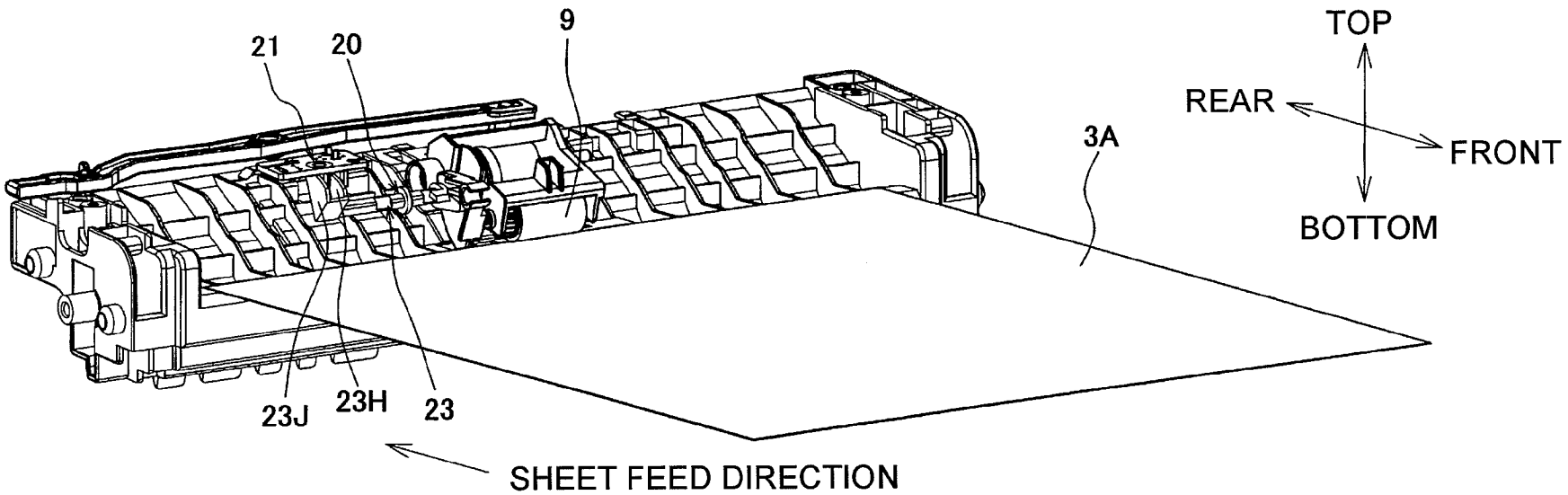
FIG. 3 is a perspective view of the sheet sensor provided in the manual tray.

When the manual feed tray 3 is opened by tilting toward the front side, a sheet slot 7 appears. A recording sheet may be supplied into the laser printer 1 through the sheet slot 7. The recording sheet placed in the manual feed tray 3 is applied with a force and fed from the sheet slot 7 into the housing 5 by a pickup roller 9 (FIG. 2), undergoes an image forming (e.g. printing) process, and is ejected to a sheet ejection tray 10 disposed in an upper portion of the housing 5.

In the housing 5, an image forming unit and a sheet supply tray are disposed. The image forming unit is made up of a scanner, a photosensitive member, and a fixing device. The sheet supply tray stores a stack of recording sheets to be supplied to the image forming unit.

A sheet sensor 20 is a sensing device configured to sense presence of a recording sheet in a sheet input portion 3A of the manual feed tray 3.

Figure 4:
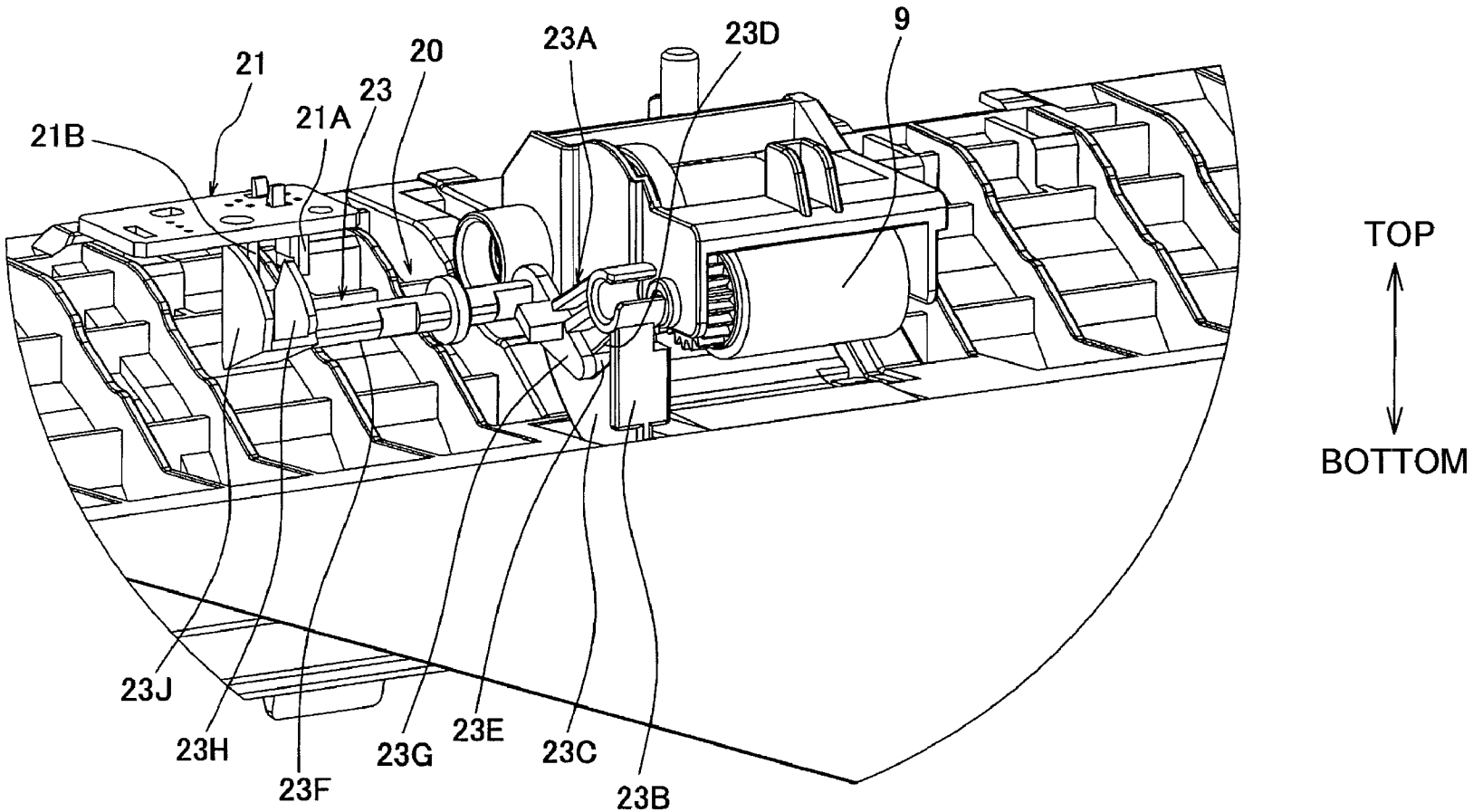
FIG. 4 is an enlarged perspective view of the sheet sensor in FIG. 2.
Figure 5:
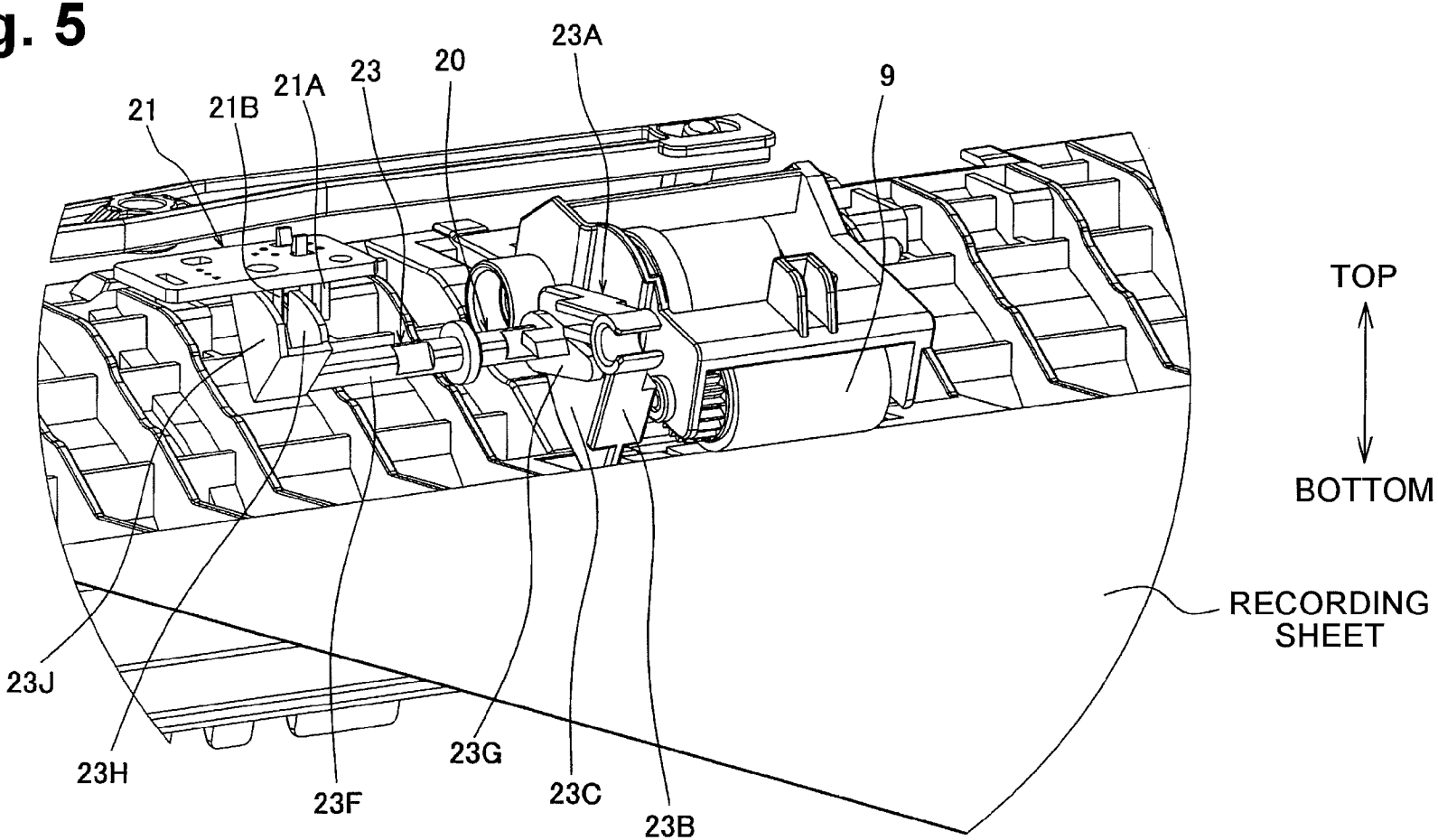
FIG. 5 is an enlarged perspective view of the sheet sensor in FIG. 3.

As shown in FIGS. 4 and 5, the sheet sensor 20 includes a sensor, such as a photo sensor 21, and a sensor actuator 23. The photo sensor 21 includes a light emitting element 21A that emits light and a light receiving element 21B that is configured to receive the light emitted from the light emitting element 21A. The sensor actuator 23 is configured to operate in response to detecting a recording sheet, such as by contacting the recording sheet, and cause a transition between a first state where light emitted from the light emitting element 21A is received at the light receiving element 21B and a second state where the light is not received at the receiving element 21B.

Figure 6:
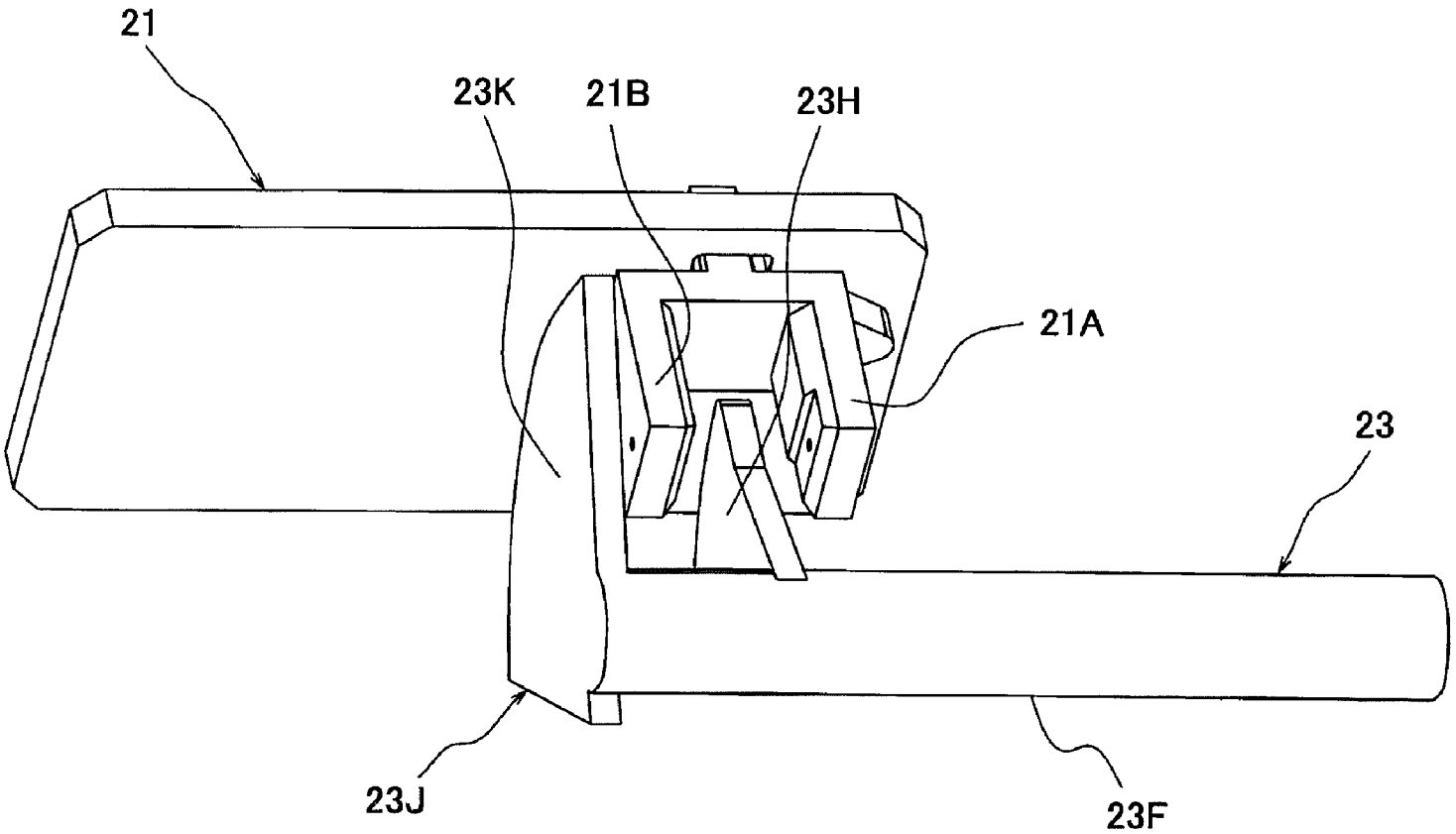
FIG. 6 is a perspective view of a photo sensor of the sheet sensor according to a first illustrative embodiment of the invention.
Figure 7B:
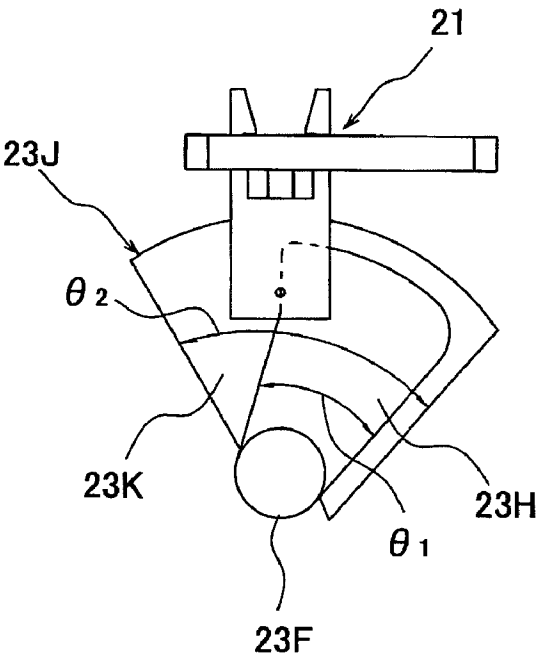
FIG. 7B is a side view of the photo sensor according to the first illustrative embodiment.
Figure 7A:
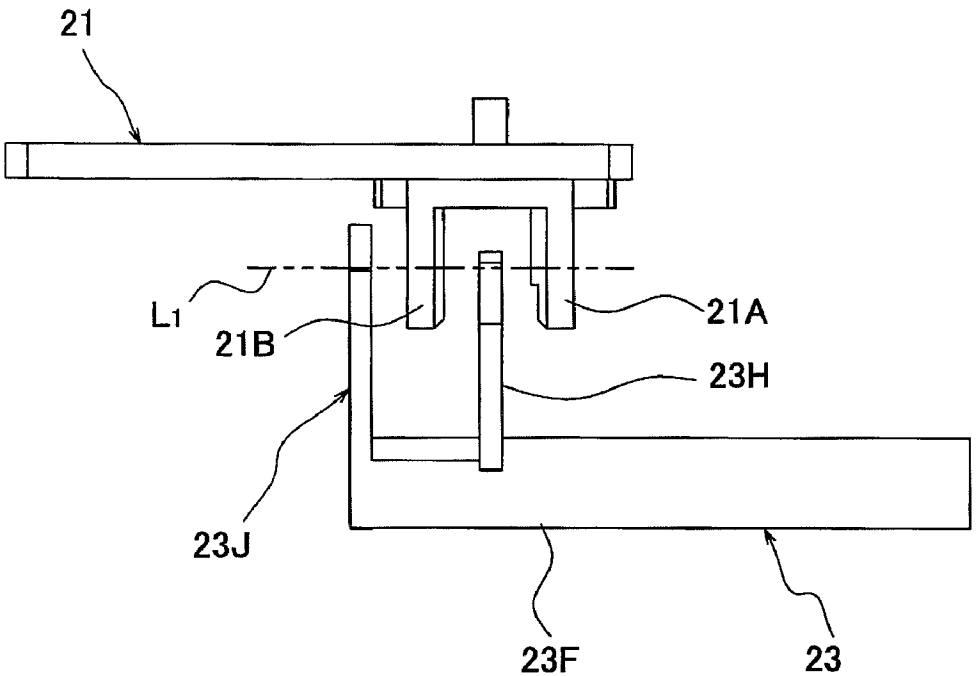
FIG. 7A is a front view of the photo sensor according to the first illustrative embodiment.

The photo sensor 21 can be a transparent type photo sensor or a photo interrupter where the light emitting element 21A and the light receiving element 21B are disposed facing each other as shown in FIGS. 6 and 7A. The sensor actuator 23 includes an oscillating link mechanism 23A and a fan-shaped light path shielding member 23H as shown in FIGS. 4 and 5. The oscillating link mechanism 23A is configured to move in contact with a leading end of a recording sheet. The light path shielding member 23H is disposed to an end of a rotating shaft 23F of the oscillating link mechanism 23A.

The oscillating link mechanism 23A includes a first oscillating member 23B, a second oscillating member 23C, and a link lever 23G, as shown in FIG. 4. The first oscillating member 23B is configured to oscillate around a shaft (not shown) in contact with the leading end of a recording sheet. The second oscillating member 23C is configured to oscillate together with the first oscillating member 23B. The link lever 23G has an oscillating pin 23E slidingly inserted into a cam groove 23D formed in the second oscillating member 23C, and is configured to transmit movement of the first oscillating member 23B to the rotating shaft 23F.

As the first oscillating member 23B oscillates in response to contact with a recording sheet, the rotating shaft 23F rotates. That is, the rotating shaft 23F rotates in response to a recording sheet being detected. The light path shielding member 23H moves between a position in the second state to cut off a light path from the light emitting element 21A to the light receiving element 21B and a position in the first state to open the light path.

Specifically, without any recording sheet placed in the sheet input portion 3A of the manual feed tray 3, the light path shielding member 23H does not shield the light path, as shown in FIG. 4, and the light receiving element 21B is capable of receiving light from the light emitting element 21A. With a recording sheet placed in the sheet input portion 3A of the manual feed tray 3, the light path shielding member 23H shields the light path as shown in FIG. 5, and the light receiving element 21B is not capable of receiving light from the light emitting element 21A.

However, as the photo sensor 21 is generally disposed in proximity to the manual feed tray 3, the light receiving element 21B is liable to receive light reflected at a recording sheet placed in the manual feed tray 3. If the light receiving element 21B receives the reflected light, the photo sensor 21 may sense that the light path is not shielded although the light path is actually shielded by the light path shielding member 23H.

In other words, when light other than the light emitted from the light emitting element 21A is launched into the light receiving element 21B, the photo sensor 21 may wrongly sense that no recording sheet is placed in the manual tray 3, although there is a recording medium placed in the manual tray 3. As a result, a mechanism to feed a recording sheet may not operate.

Such false detection may occur not only in the photo sensor 21 disposed close to the manual feed tray 3 but also in a sensor disposed in a position susceptible to the outside light within the image forming apparatus.

Thus, to prevent light other than that emitted from the light emitting element 21A from entering the light receiving element 21B, a light shield such as light shielding cover 23J is coupled to an end of the rotating shaft 23F on the rear side of the light receiving element 21B, which is a side of the light receiving element 21B opposite from the light emitting element 21A. For example, as shown in FIGS. 6 and 7, the light shielding cover 23J may be integrally formed with an end of the rotating shaft 23F. The light shielding cover 23J covers the photo sensor 21 on the light receiving element 21B side. In another illustrative example, the light shielding cover 23J may be coupled with an end of the rotating shaft 23F using adhesive.

The light shielding cover 23J has a light shielding surface 23K extending in a direction substantially perpendicular to an axial direction of the rotating shaft 23F, as shown in FIG. 7B. The light shielding surface 23K is configured to prevent light other than light emitted from the light emitting element 21A from entering the light receiving element 21B at least as long as the light path is shielded by the light path shielding member 23H.

Specifically, the light shielding surface 23K is fan-shaped with a central angle θ2, which is greater than a central angle θ1 of the light path shielding member 23H. The light shielding surface 23K is configured to be co-linear with a line connecting the light emitting element 21A and the light receiving element 21B, that is, a line L1 of FIG. 7A, while the light path is shielded by the light path shielding member 23H.

In the embodiment, the central angle θ2 of the light shielding surface 23K is substantially equivalent to the maximum angle of rotation of the rotating shaft 23F, and the light shielding surface 23K is combined with the rotating shaft 23F at such a position as to cover the light receiving element 21B from one end of the rotating shaft 23F even if there is no recording sheet in the sheet input portion 3A of the manual feed tray 3.

As described above, when the first oscillating member 23B oscillates in contact with the recording sheet, the light shielding cover 23J moves together with the light path shielding member 23H and covers the photo sensor 21 from the light receiving element 21B side. Thus, light other than that emitted from the light emitting element 21A can be prevented from entering the light receiving element 21B.

As a result, the failure to detect the presence of a recording sheet in the manual feed tray 3 can be prevented from occurring.

To prevent light other than that emitted from the light emitting element 21A from entering the light receiving element 21B, covering the photo sensor 21 entirely with a cover is seen as a potential solution. However, this solution may require another operation for assembling the cover to protect the photo sensor 21, which will lead to an increase in the number of assembling operations of the laser printer 1, inviting the rise in manufacturing cost of the laser printer 1.

In this illustrative embodiment, the light shielding cover 23J can be combined with the sensor actuator 23. When the sensor actuator 23 is assembled, the light shielding cover 23J can be, but is not required to be, simultaneously assembled. Thus, in aspects of this illustrative embodiment, an apparatus may be provided which prevents false detection without incurring an increase in the number of assembling operations of the laser printer 1.

The light shielding cover 23J is configured to prevent light other than that emitted from the light emitting element 21A from entering the light receiving element 21B at least while the light path is shielded by the light path shielding member 23H. Thus, a detection error can be prevented from occurring.

In this illustrative embodiment, the central angle θ2 of the light shielding surface 23K is substantially equivalent to the maximum angle of rotation of the rotating shaft 23F. As the light shielding surface 23K is disposed at such a position to cover the light receiving element 21B on one axial end of the rotating shaft 23F, it can cover the photo sensor 21 from the side of the light receiving element 21B in the movable range of the light path shielding member 23H even if there is no recording sheet in the sheet input portion 3A.

Figure 8:
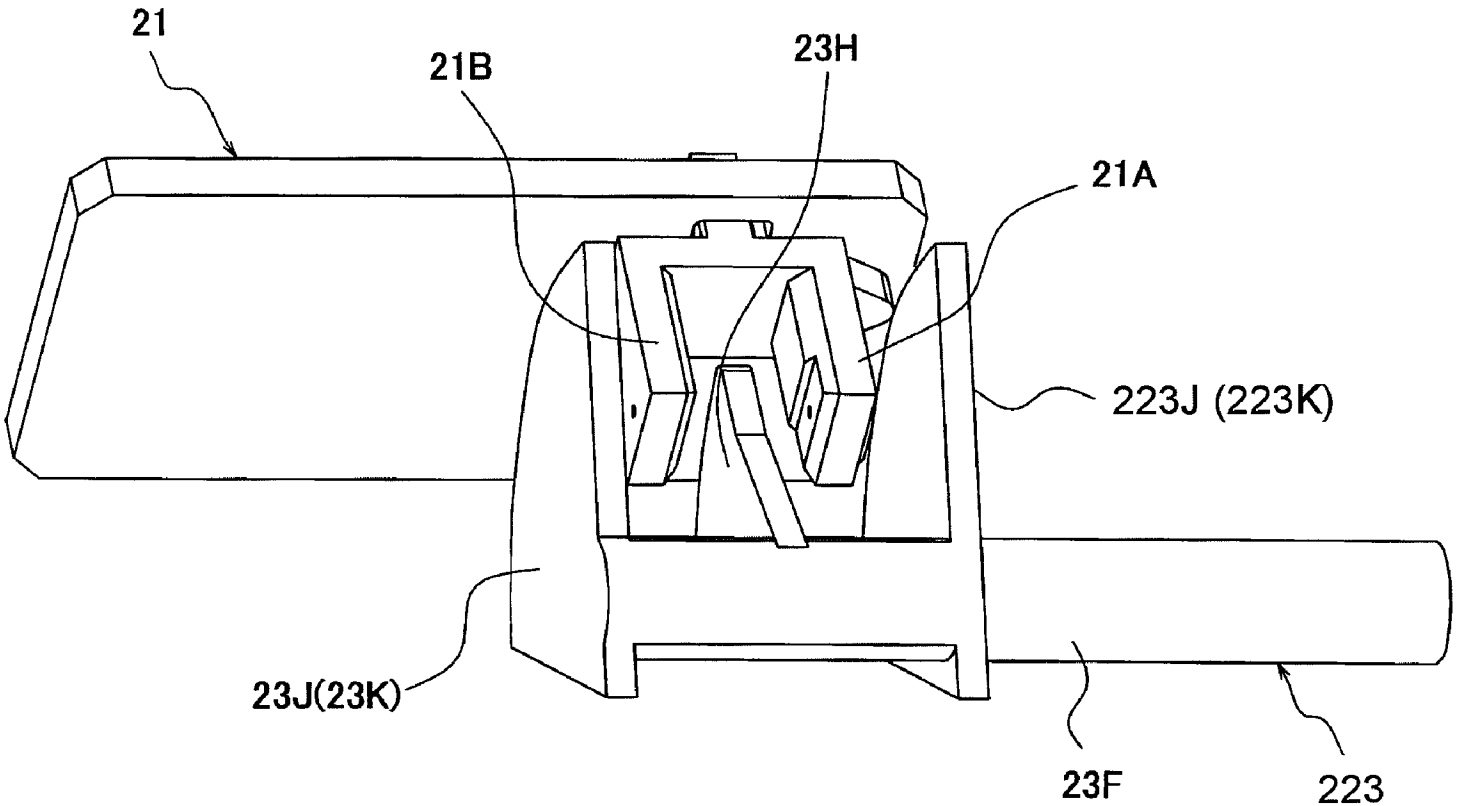
FIG. 8 is a perspective view of the photo sensor and a sensor actuator according to a second illustrative embodiment.
Figure 9B:
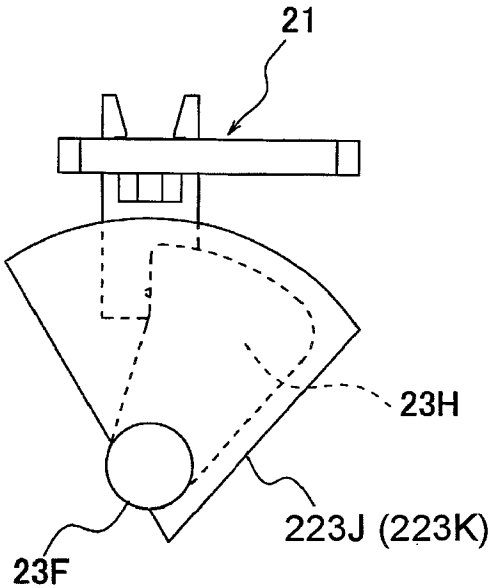
FIG. 9B is a side view of FIG. 9A.
Figure 9A:
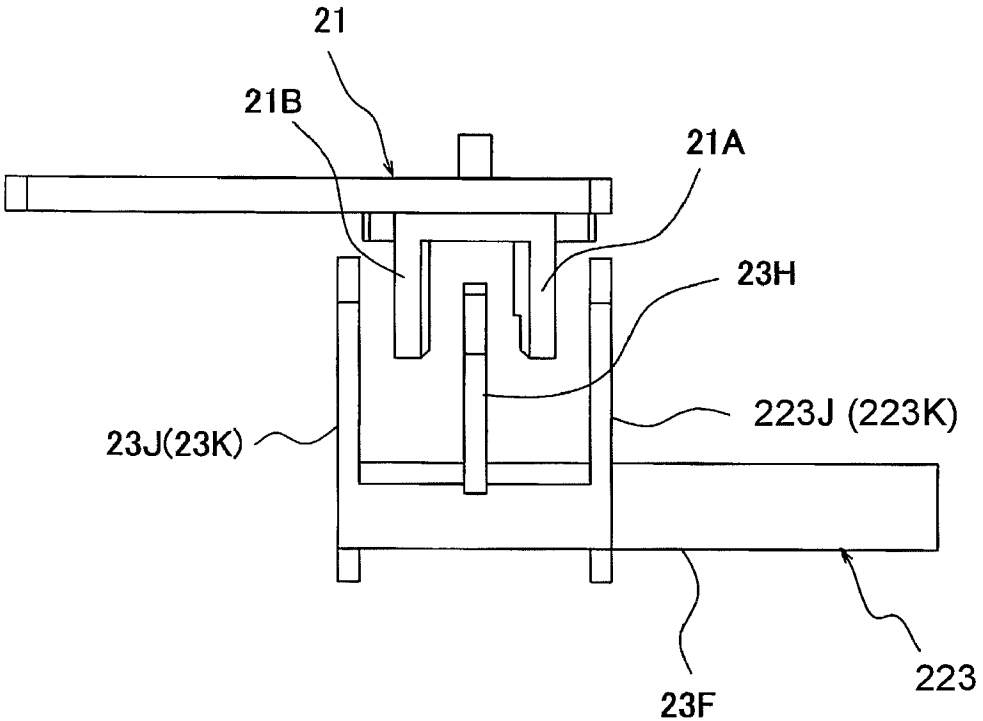
FIG. 9A is a front view of FIG. 8.

A second illustrative embodiment of the invention will be described with reference to FIGS. 8 and 9. In FIGS. 8 and 9, a sensor actuator 223 is a variant of the sensor actuator 23 of the first illustrative embodiment, parts substantially equivalent to those described above are denoted by the same reference numerals, and descriptions thereof will be omitted.

The sensor actuator 223 may be used instead of the sensor actuator 23 of the first illustrative embodiment. In the first illustrative embodiment, the sensor actuator 23 includes the light shielding cover 23J where the light shielding surface 23K is provided only on the rear side of the light receiving element 21B. In the second illustrative embodiment, as shown in FIGS. 8 and 9, the sensor actuator 223 includes a light shielding cover 223 having a light shielding surface 223K in addition to the light shielding cover 23. The light shielding surface 223K is provided on the rear side of the light emitting element 21A, which is opposite from a side of the light emitting element 21A which opposes the light receiving element 21B. The light shielding cover 23 and the light shielding cover 223 are identical in size and shape.

With this structure, light other than light emitted from the light emitting element 21A can be reliably prevented from entering the light receiving element 21B, and false detection can be prevented from occurring.

Figure 10:
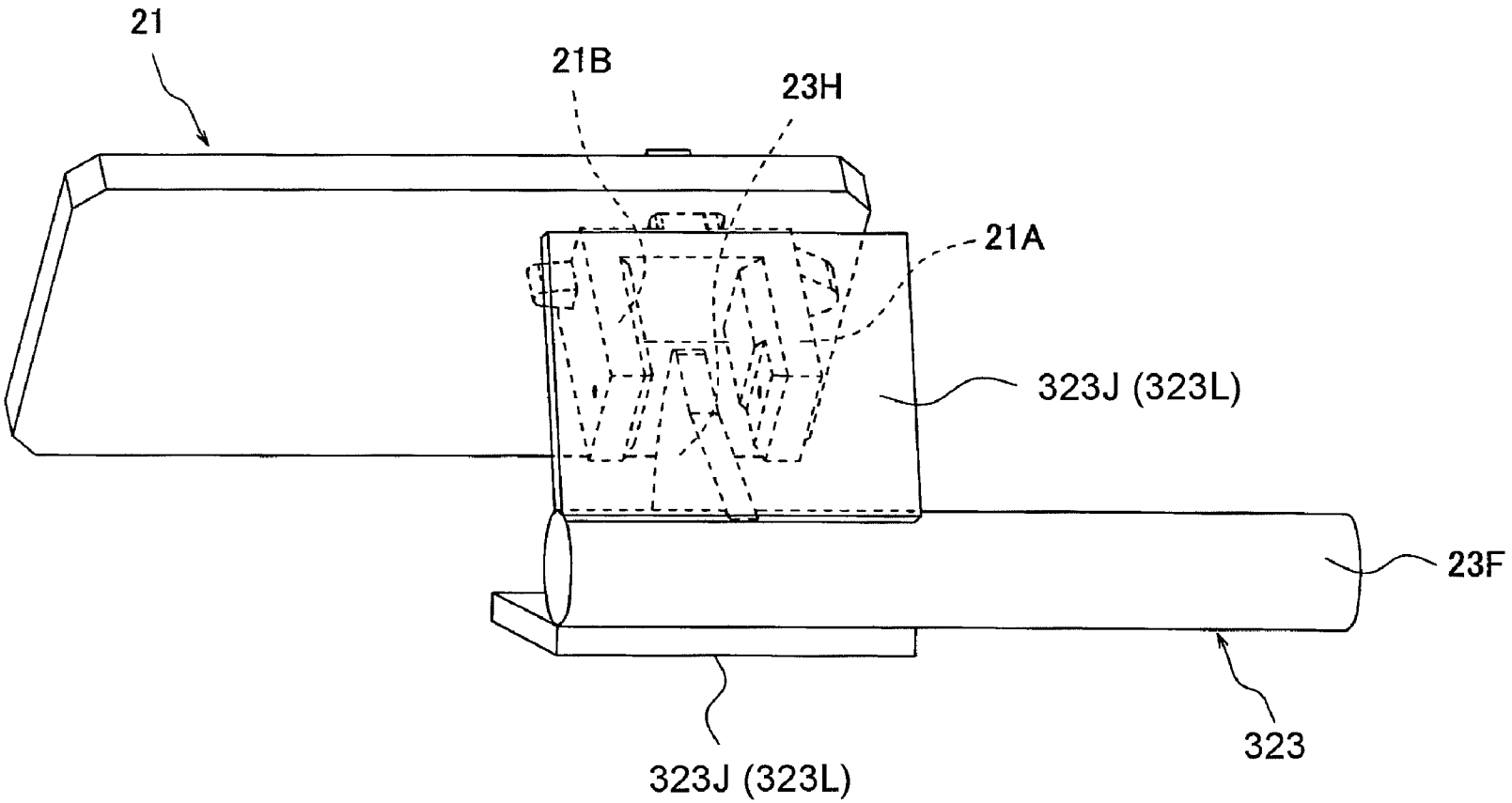
FIG. 10 is a perspective view of the photo sensor and a sensor actuator according to a third illustrative embodiment of the invention.
Figure 11B:
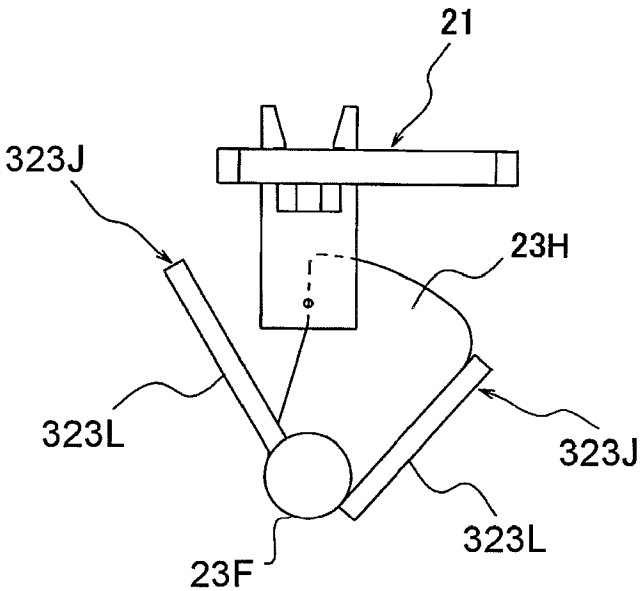
FIG. 11B is a side view of FIG. 11A.
Figure 11A:
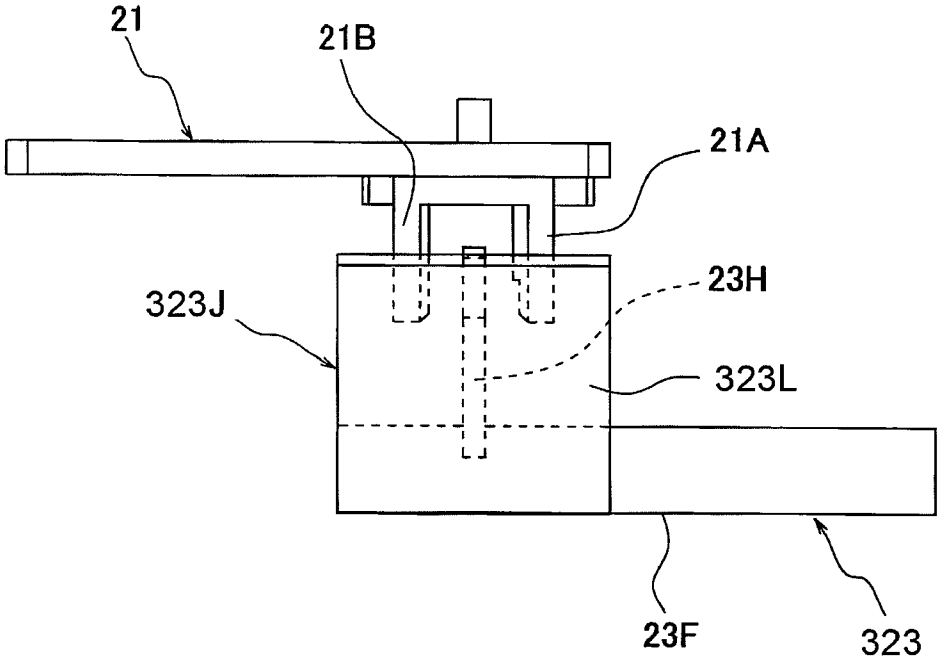
FIG. 11A is a front view of FIG. 10.

A third illustrative embodiment of the invention will be described with reference to FIGS. 10 and 11. In FIGS. 10 and 11, a sensor actuator 323 is a variant of the sensor actuator 23 of the first illustrative embodiment, and parts substantially equivalent to those described above are denoted by the same reference numerals and descriptions thereof will be omitted.

The sensor actuator 323 may be used instead of the sensor actuator 23 of the first illustrative embodiment. In the first illustrative embodiment, the light shielding cover 23J includes the light shielding surface 23K extending in the direction substantially perpendicular to the axial direction of the rotating shaft 23F. In the third illustrative embodiment, as shown in FIGS. 10 and 11, the sensor actuator 323 includes light shielding covers 323J. Each light shielding cover 323J includes a light shielding surface 323L extending in a direction substantially parallel to the axial direction of the rotating shaft 23F.

The light shielding surfaces 323L are disposed on the rotating shaft 23F in a direction substantially perpendicular to a moving direction of the light path shielding member 23H so as to cover the photo sensor 21 in the moving direction of the light path shielding member 23H.

With this structure, light coming in the photo sensor 21 in the moving direction of the light path shielding member 23H can be cut off. Thus, light other than light emitted from the light emitting element 21A can be prevented from entering the light receiving element 21B, and false detection can be prevented from occurring.

As the light shielding covers 323J can be formed integrally with the sensor actuator 323, the increase in the number of assembling operations of the laser printer 1 can be prevented, and false detection can be prevented from occurring, as with the first and second illustrative embodiments.

Figure 12:
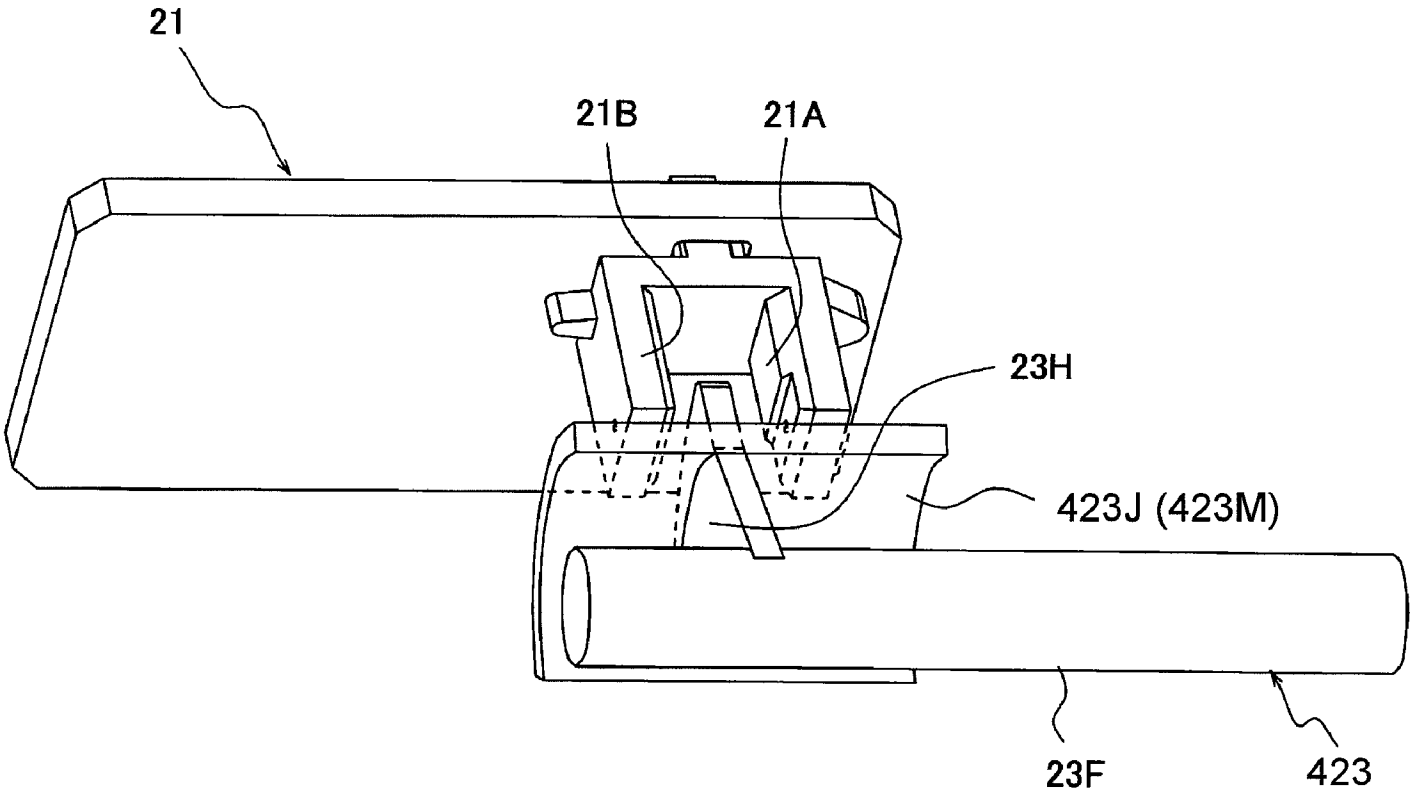
FIG. 12 is a perspective view of the photo sensor and a sensor actuator according to a fourth illustrative embodiment of the invention.
Figure 13B:
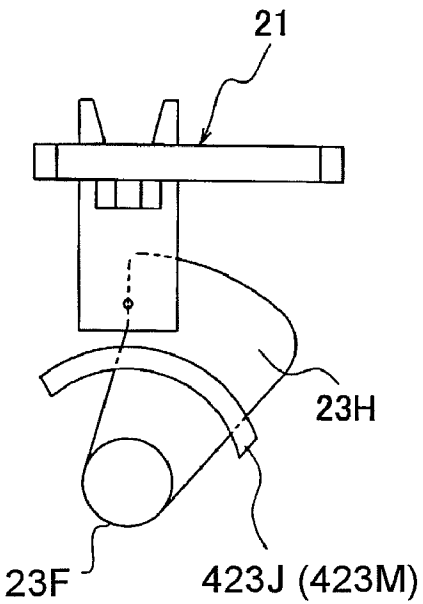
FIG. 13B is a side view of FIG. 13A.
Figure 13A:
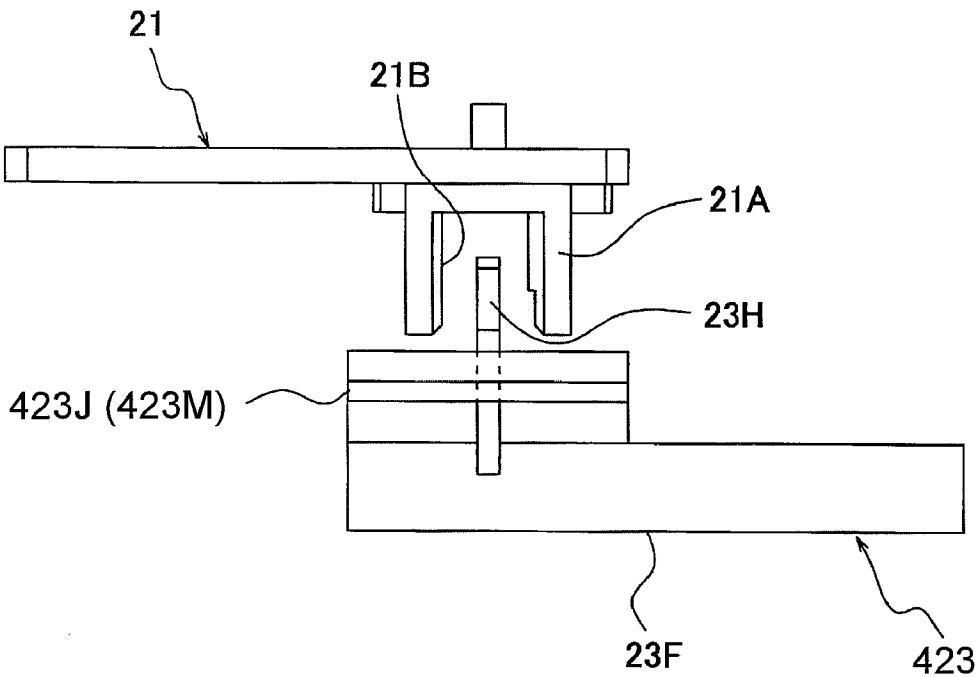
FIG. 13A is a front view of FIG. 12.

A fourth illustrative embodiment of the invention will be described with reference to FIGS. 12 and 13. In FIGS. 12 and 13, a sensor actuator 423 is a variant of the sensor actuator 23 of the first illustrative embodiment, and parts substantially equivalent to those described above are denoted by the same reference numerals and descriptions thereof will be omitted.

The sensor actuator 423 may be used instead of the sensor actuator 23 of the first illustrative embodiment. As shown in FIGS. 12 and 13, the sensor actuator 423 includes a light shielding cover 423J. The light shielding cover 423J includes a light shielding surface 423M, which is a cylindrical surface extending in a direction substantially parallel to the axial direction of the rotating shaft 23F. The light shielding surface 423M is disposed between the rotating shaft 23F and the photo sensor 21, and is coupled to, such as formed integrally with the light path shielding member 23H.

With this structure, light coming in the photo sensor 21 from the rotating shaft 23F side can be cut off. Thus, light other than light emitted from the light emitting element 21A can be prevented from entering the light receiving element 21B and false detection can be prevented from occurring.

Figure 14:
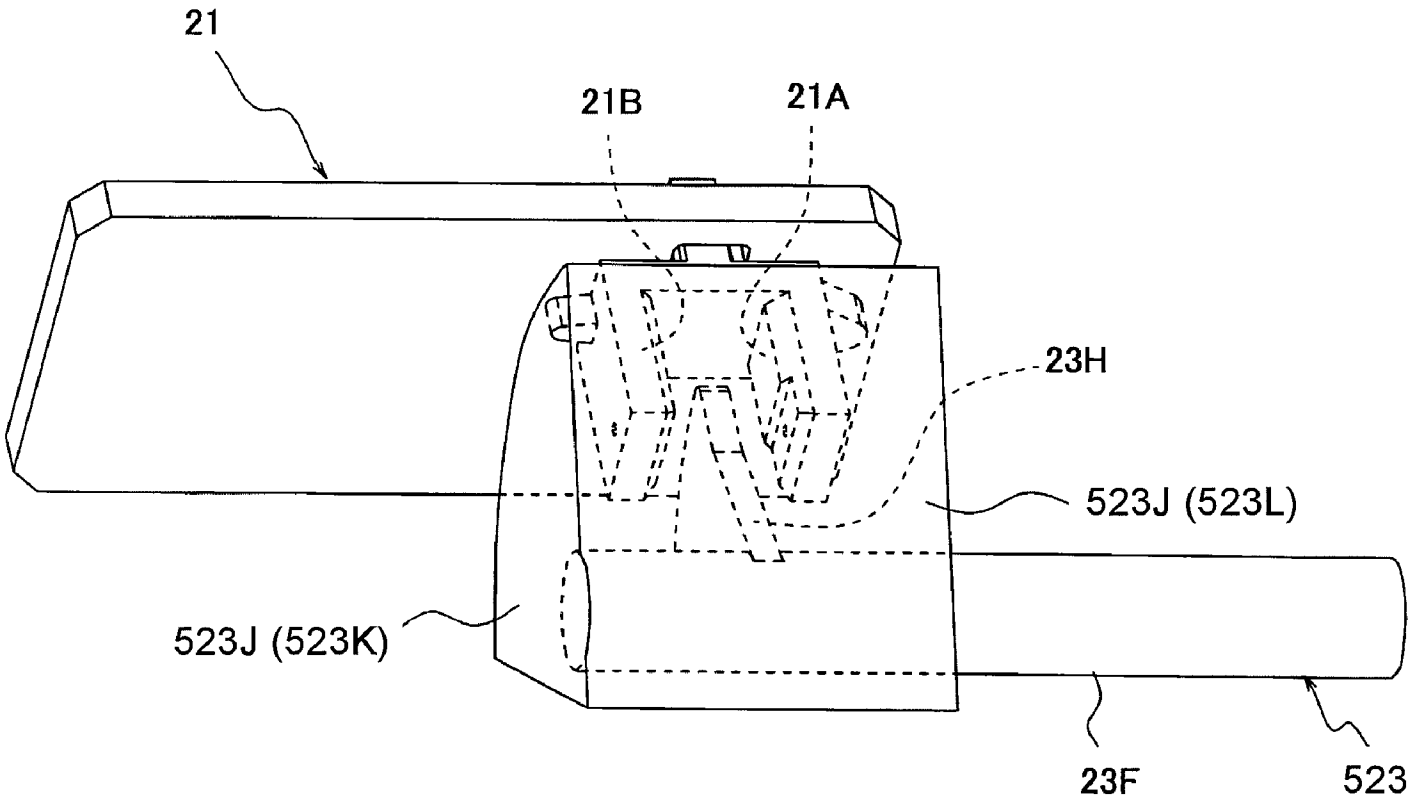
FIG. 14 is a perspective view of the photo sensor and a sensor actuator according to a fifth illustrative embodiment of the invention.
Figure 15B:
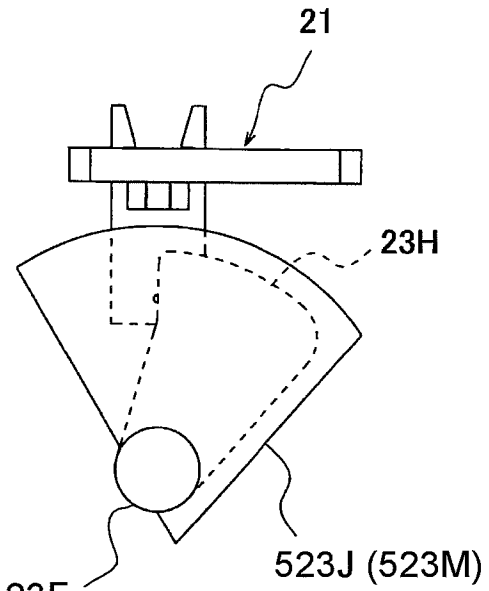
FIG. 15B is a side view of FIG. 15A.
Figure 15A:
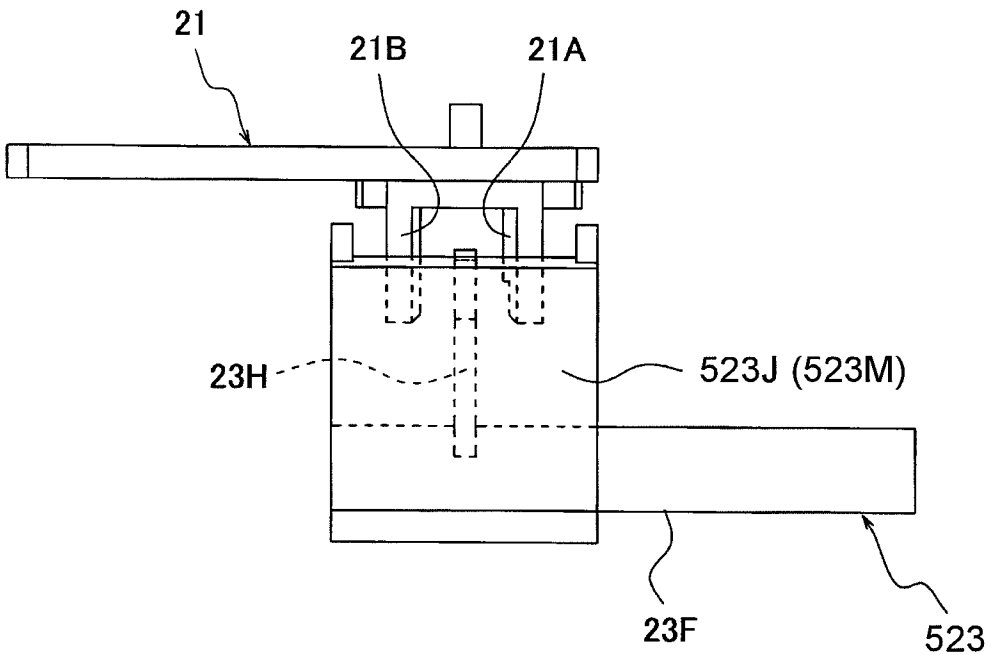
FIG. 15A is a front view of FIG. 14.

A fifth illustrative embodiment of the invention will be described with reference to FIGS. 14 and 15. In FIGS. 14 and 15, a sensor actuator 523 is a variant of the sensor actuator 23 of the first illustrative embodiment, and parts substantially equivalent to those described above are denoted by the same reference numerals and descriptions thereof will be omitted.

The sensor actuator 523 may be used instead of the sensor actuator 23 of the first illustrative embodiment. The fifth illustrative embodiment is a combination of the second third illustrative embodiments. Specifically, in the fifth illustrative embodiment, as shown in FIGS. 14 and 15, the sensor actuator 523 includes a light shielding cover 523J. The light shielding cover 523 includes two light shielding surfaces 523K disposed on the rotating shaft 23F in a direction perpendicular to the axial direction thereof to cover respective rear sides of the light emitting element 21A and the light receiving element 21B, and two light shielding surfaces 523L disposed on the rotating shaft 23F along the axial direction thereof to sandwich the light path shielding member 23H. The two light shielding surfaces 523K and the two light shielding surfaces 523L are coupled to each other, such as being integrally formed as shown in FIG. 14, using adhesives or the like. The light shielding surfaces 523L are coupled to light shielding surfaces 523K in different planes.

With this structure, light other than light emitted from the light emitting element 21A can be reliably prevented from entering the light receiving element 21B, and false detection can be prevented from occurring.

Figure 16:
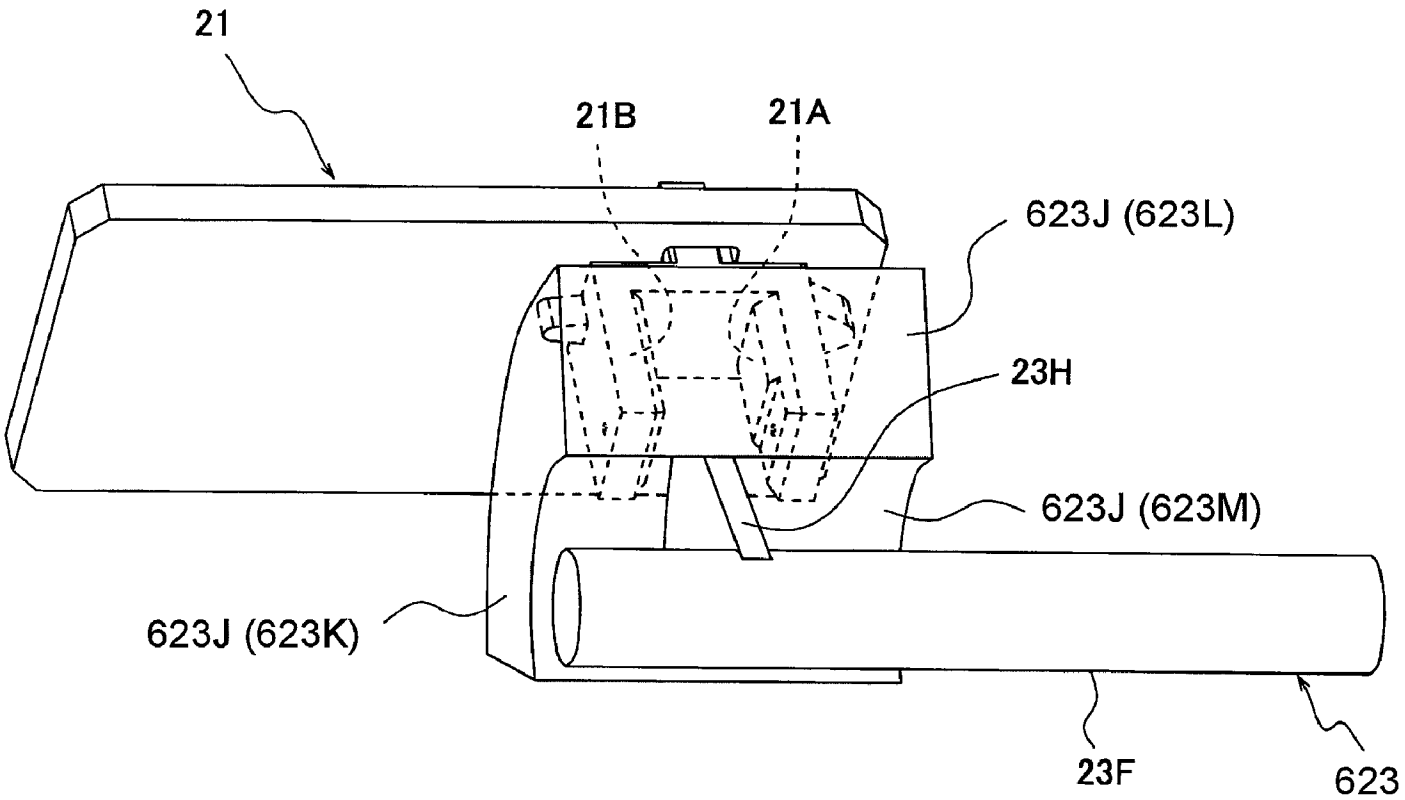
FIG. 16 is a perspective view of the photo sensor and a sensor actuator according to a sixth illustrative embodiment of the invention.
Figure 17B:
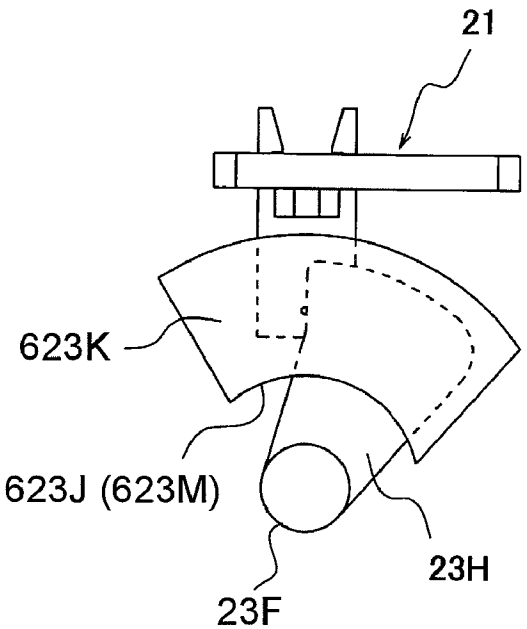
FIG. 17B is a side view of FIG. 17A.
Figure 17A:
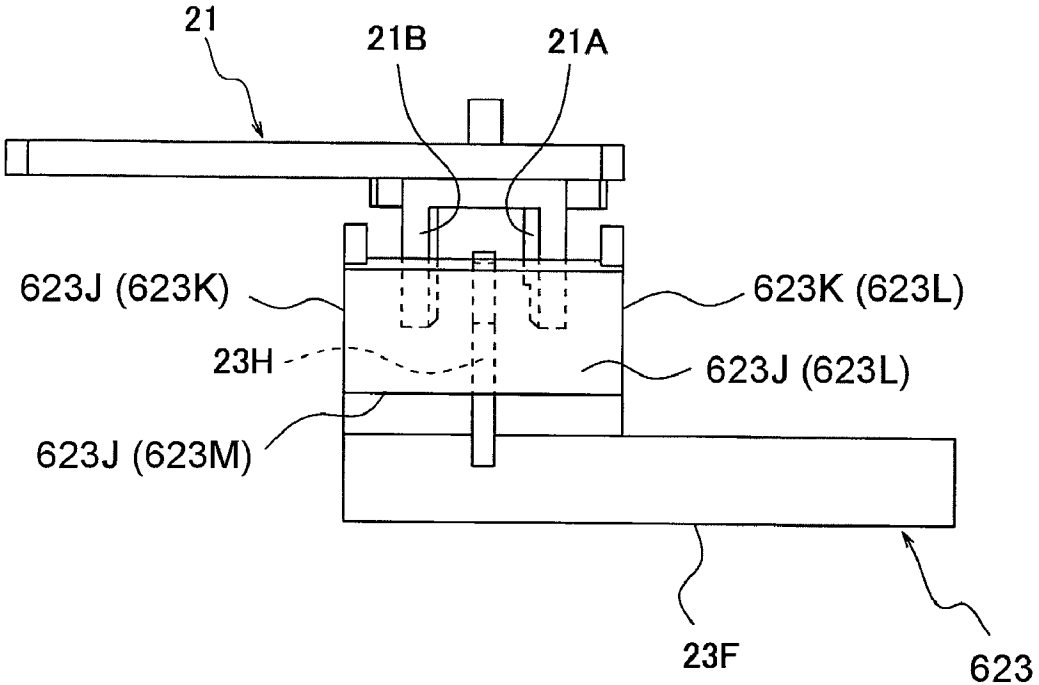
FIG. 17A is a front view of FIG. 16.

A sixth illustrative embodiment of the invention will be described with reference to FIGS. 16 and 17. In FIGS. 16 and 17, a sensor actuator 623 is a variant of the sensor actuator 23 of the first illustrative embodiment, and parts substantially equivalent to those described above are denoted by the same reference numerals and descriptions thereof will be omitted.

The sensor actuator 623 may be used instead of the sensor actuator 23 of the first illustrative embodiment. The sixth illustrative embodiment is a combination of the light shielding cover 523J of the fifth illustrative embodiment and the light shielding surface 423M of the fourth illustrative embodiment. Specifically, as shown in FIGS. 16 and 17, the sensor actuator 623 includes a light shielding cover 623J. The light shielding cover 623J includes two light shielding surfaces 623K disposed to cover the respective rear sides of the light emitting element 21A and the light receiving element 21B, two light shielding surfaces 623L disposed between the light shielding surfaces 623K along the axial direction of the rotating shaft 23F to sandwich the light path shielding member 23H, and a light shielding surface 623M, which is a cylindrical surface extending in a direction substantially parallel to the axial direction of the rotating shaft 23F and disposed continuously between the light shielding surfaces 623L. The two light shielding surfaces 623K, the two light shielding surfaces 623L, and the light shielding surface 623M are coupled to each other, such as integrally formed as shown in FIG. 16, using adhesives or the like. The light shielding surface 623M is disposed between the rotating shaft 23F and the photo sensor 21, and coupled to, such as formed integrally with, the rotating shaft 23F via the light path shielding member 23H.

With this structure, light other than light emitted from the light emitting element 21A can be reliably prevented from entering the light receiving element 21B, and false detection can be prevented from occurring.

Figure 18:
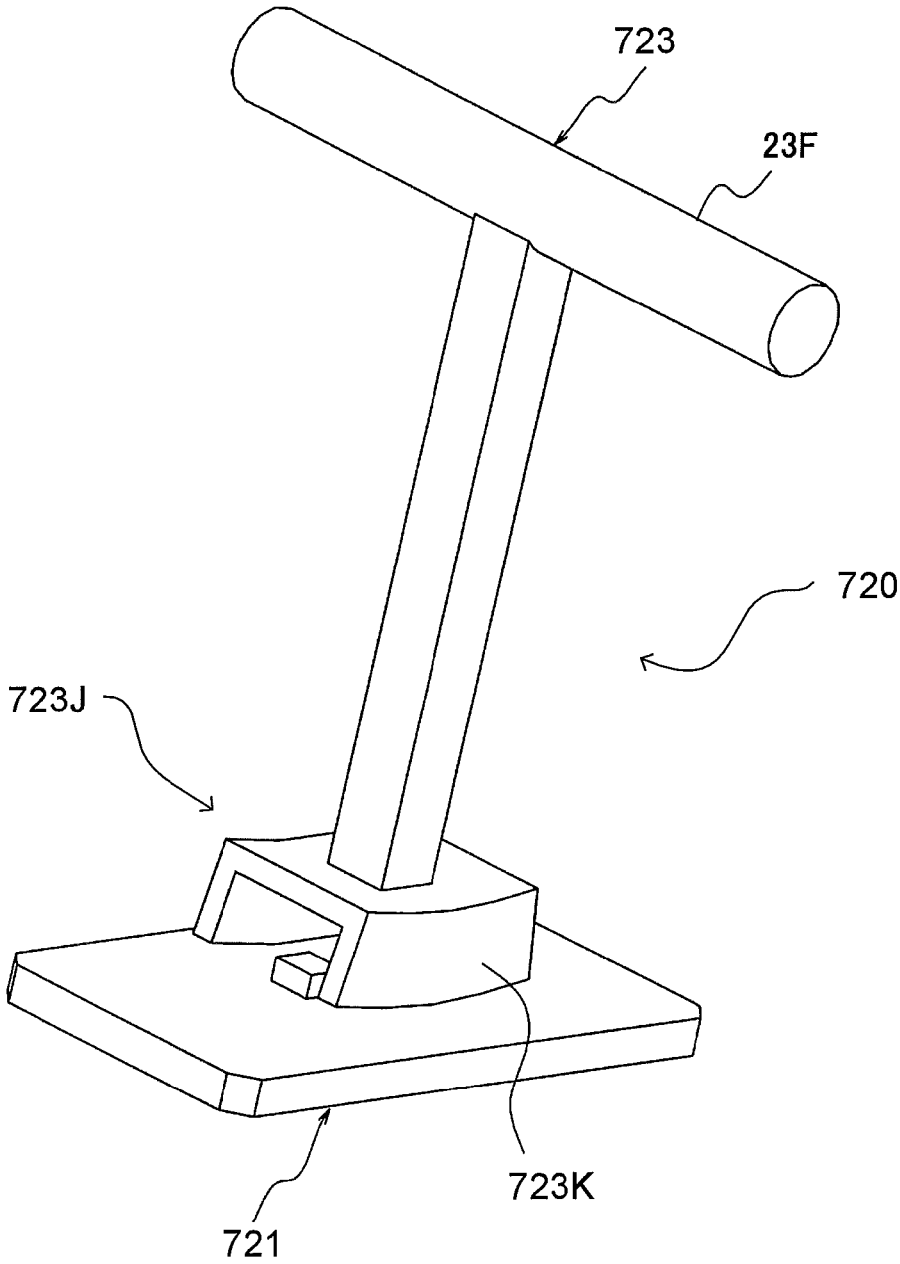
FIG. 18 is a perspective view of the photo sensor and a sensor actuator according to a seventh illustrative embodiment of the invention.

A seventh illustrative embodiment of the invention will be described with reference to FIGS. 18 and 19. In FIGS. 18 and 19, a sheet sensor 720 is a variant of the sheet sensor 20 of the first illustrative embodiment, and parts substantially equivalent to those described above are denoted by the same reference numerals and descriptions thereof will be omitted.

As shown in FIG. 18, the sheet sensor 720 includes a photo sensor 721 and a sensor actuator 723. While the sheet sensor 20 in the above illustrative embodiments is provided with the transparent type photo sensor 21 in which the light emitting element 21A and the light receiving element 21B are disposed to face each other, the photo sensor 721 of the sheet sensor 720 is a reflecting type in which a light emitting element 721A and a light receiving element 721B are disposed in one plane, and light emitted from the light emitting element 721A is reflected and the reflected light is directed to the light receiving element 721B.

Figure 19B:
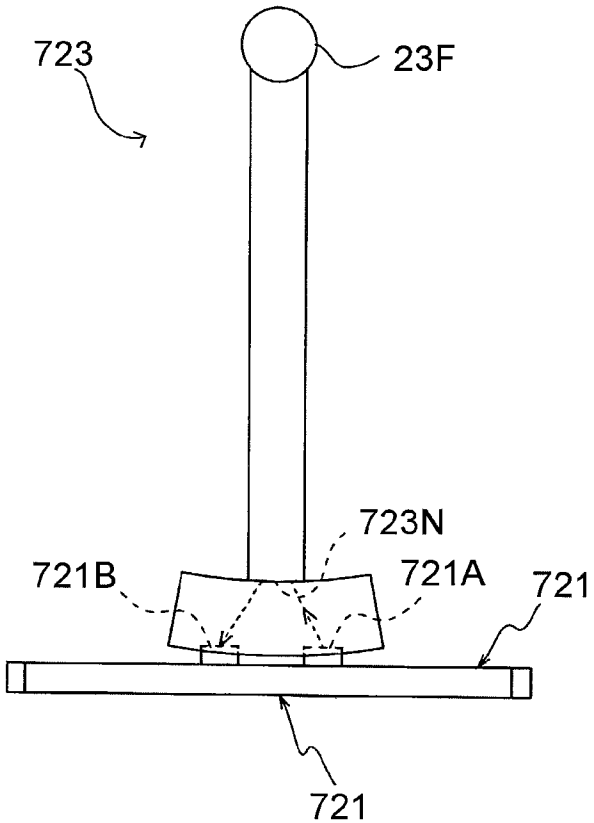
FIG. 19B is a side view of FIG. 19A.
Figure 19A:
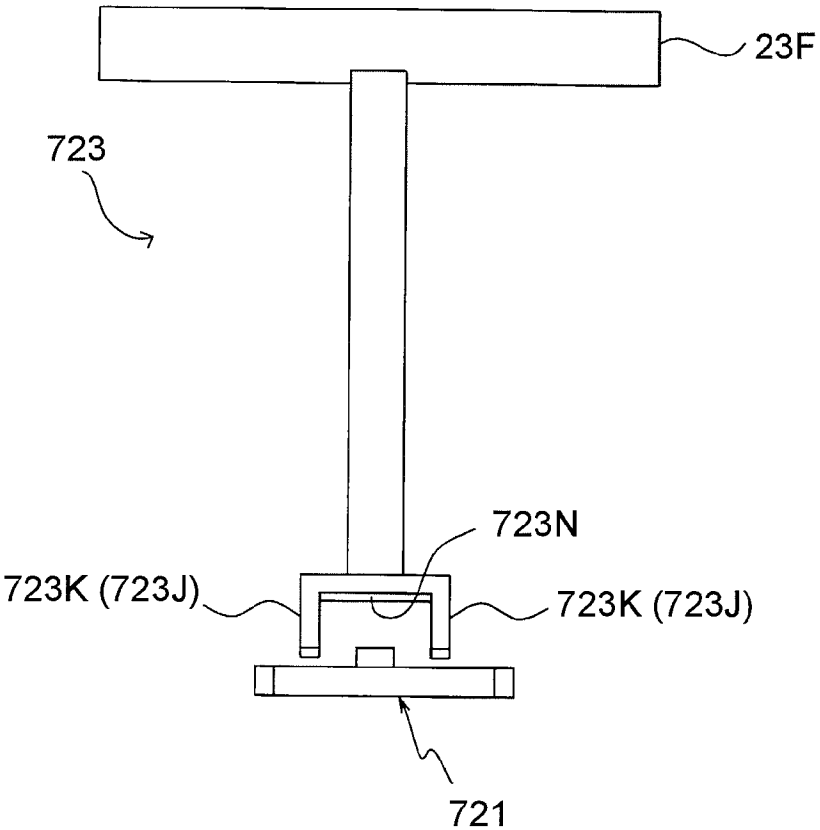
FIG. 19A is a front view of FIG. 18.

As show in FIG. 19B, the light emitting element 721A is disposed to emit light toward a rotating shaft 23F, and the light receiving element 721B is disposed to receive the light coming from the rotating shaft 23F. A reflecting plate 723N is disposed between the light emitting element 721A, the light receiving element 721B, and the rotating shaft 23F, as shown in FIG. 19A. The reflecting plate 723N is configured to move integrally with the rotating shaft 23F.

As the reflecting plate 723N moves in response to detecting of a recording sheet by a contact of the first oscillating member 23B with a recording sheet, light emitted from the light emitting element 721A may be reflected at the reflecting plate 723N and directed to the light receiving element 721B or may not be reflected at the reflecting plate 723N and not be directed to the light receiving element 721B.

In other words, as the reflecting plate 723N moves together with the rotating shaft 23F, light emitted from the light emitting element 721A may or may not be able to be received by the light receiving element 721B.

As shown in FIG. 19A, a light shielding cover 723J includes two light shielding surfaces 723K disposed perpendicularly to an axial direction of the rotating shaft 23F. The light shielding surfaces 723K are coupled to, such as formed integrally with, the reflecting plate 723N to sandwich the reflecting plate 723N inside with respect to the axial direction.

The light shielding cover 723J moves along with the movement of the reflecting plate 723N to cover the photo sensor 721. Thus, light other than light emitted from the light emitting element 721A can be prevented from entering the light receiving element 721B. As a result, false detection, for example, that the presence of a recording sheet in the manual feed tray 3 can not be detected can be prevented from occurring.

The light shielding cover 721J is coupled to and may be formed integrally with the sensor actuator 723. When the sensor actuator 723 is assembled, the light shielding cover 723J can be simultaneously assembled. Thus, in aspects of this illustrative embodiment, false detection can be prevented without incurring an increase in the number of assembling operations of the laser printer 1.

The light shielding surfaces 23K, 223K, 523K, 623K, and 723K are provided so as to extend in a direction substantially perpendicular to the axial direction of the rotating shaft 23F. The direction in which the light shielding surfaces 23K, 223K, 523K, 623K, and 723K extend is not limited to the perpendicular direction. The light shielding surfaces 23K, 223K, 523K, 623K, and 723K may be provided so as to extend in any direction as long as they extend in a direction intersecting the axial direction of the rotating shaft 23F.

The invention may be applied to, but is not limited to, the sheet sensors 20, 720 disposed in the manual feed tray 3 in the above illustrative embodiments. For example, the invention may be applied to a registration sensor configured to detect a recording sheet to be fed to an image forming part.

The invention may be applied to, but is not limited to, a laser printer. For example, the invention may be applied to image forming apparatuses such as LED printers, inkjet printers and copiers.

Although illustrative embodiments of the invention have been described in detail herein, the scope of the invention is not limited thereto. It will be appreciated by those skilled in the art that various modifications may be made without departing from the scope of the invention. Accordingly, the illustrative embodiments disclosed herein are only exemplary. It is to be understood that the scope of the invention is not to be limited thereby, but is to be determined by the claims which follow.

What is claimed is:

1. An image forming apparatus that forms an image on a recording medium, comprising:

a sensor including a light emitting element configured to emit light and a light receiving element configured to receive light emitted from the light emitting element, the light emitting element and the light receiving element being disposed to face each other;

a sensor actuator including a light path shielding member and a rotating shaft configured to rotate in response to a recording medium being detected, the light path shielding member being configured to move between a first position to open a light path from the light emitting element to the light receiving element and a second position to cut off the light path in response to a recording medium being detected, and a light shield coupled to the sensor actuator such that the light shield moves in response to rotation of the sensor actuator, the light shield being configured to cover at least a part of the sensor and to reduce light other than light emitted from the light emitting element from entering the light receiving element when the light path shielding member is in the second position, the light shield including a first light shielding surface, the light shield being configured to be positioned such that a line passing through both the light emitting element and the light receiving element passes through the first light shielding surface when the light path shielding member is in the second position, the first light shielding surface extending in a direction substantially perpendicular to an axial direction of the rotating shaft;

wherein the light path extends substantially parallel to the axial direction of the rotating shaft.

2. The image forming apparatus according to claim 1, wherein the light shield further includes a second light shielding surface extending in the direction substantially perpendicular to the axial direction of the rotating shaft, and the sensor is interposed between the first light shielding surface and the second light shielding surface.

3. The image forming apparatus according to claim 2, wherein the light shield further includes a third light shielding surface being coupled to the first and second light shield surfaces.

4. The image forming apparatus according to claim 3, wherein the first, second, and third light shielding surfaces are integrally formed with the rotating shaft.

5. The image forming apparatus according to claim 1, further comprising a manual feed tray to which a recording medium is supplied, wherein the sensor actuator is configured to operate in response to detecting that a recording medium has been supplied to the manual feed tray.

6. The image forming apparatus according to claim 1, wherein the sensor actuator and the light shield are integrally formed.

7. The image forming apparatus according to claim 1, wherein the light shield is larger than the light path shielding member.

8. The image forming apparatus according to claim 1, wherein the light receiving element is interposed between the first light shielding surface and the light path shielding member when the light path shielding member is in the second position.

9. The image forming apparatus according to claim 1, wherein the light emitting element is interposed between the first light shielding surface and the light path shielding member when the light path shielding member is in the second position.

10. The image forming apparatus according to claim 1, wherein a distance from the rotating shaft to an end of the first light shielding surface is greater than a distance from the rotating shaft to the light path.

11. An image forming apparatus that forms an image on a recording medium, comprising:

a sensor including a light emitting element configured to emit light and a light receiving element configured to receive light emitted from the light emitting element, the light emitting element and the light receiving element being disposed to face each other;

a sensor actuator including:

a rotating shaft being configured to rotate in response to a recording medium being detected; and a light path shielding member, the light path shielding member being configured to move between a first position to open a light path from the light emitting element to the light receiving element and a second position to cut off the light path in response to a recording medium being detecting; and a light shield coupled to the rotating shaft of the sensor actuator, the light shield being configured to cover at least a part of the sensor and to reduce light other than light emitted from the light emitting element from entering the light receiving element when the light path shielding member is in the second position, the light shield including a first light shielding surface and a second light shielding surface, the first light shielding surface extending along an axial direction of the rotating shaft and in a first radial direction away from the rotating shaft and toward the sensor, the second light shielding surface extending along the axial direction of the rotating shaft and in a second radial direction away from the rotating shaft and toward the sensor;

wherein the light path shielding member is disposed between the first radial direction and the second radial direction.

12. The image forming apparatus according to claim 11, wherein the light path shielding member is coupled to at least one of the first light shielding surface and the second light shielding surface.

13. The image forming apparatus according to claim 11, wherein a distance from the rotating shaft to an end of one of the first light shielding surface and the second light shielding surface is greater than a distance from the rotating shaft to the light path.

14. The image forming apparatus according to claim 11, wherein each of the first light shielding surface and the second light shielding surface has a width with respect to the rotating shaft, and the width is greater than a length of the light path.

15. The image forming apparatus according to claim 11, wherein the first light shielding surface and the second light shielding surface are formed integral with the rotating shaft.

* * * * *